United States Patent [19]

Lucca et al.

[11] Patent Number: 4,951,456

[45] Date of Patent: Aug. 28, 1990

[54] CAP SPINNING DEVICE

[75] Inventors: Angelo Lucca; Andre Lattion, both of Seuzach, Switzerland

[73] Assignee: Rieter Machine Works Ltd., Winterthur, Switzerland

[21] Appl. No.: 298,699

[22] Filed: Jan. 19, 1989

[30] Foreign Application Priority Data

Jan. 21, 1988 [CH] Switzerland ..... 00204/88

[51] Int. Cl.[5] ..... D01H 7/00; D01H 7/26; D01H 7/66; D01H 13/04

[52] U.S. Cl. ..... 57/354; 57/67; 57/74; 57/115; 57/127

[58] Field of Search ..... 57/67–71, 57/73, 74, 115–117, 127, 352, 354

[56] References Cited

U.S. PATENT DOCUMENTS

| | | | |
|---|---|---|---|
| 2,180,792 | 11/1939 | Casablancas | 57/115 X |
| 2,449,431 | 9/1948 | Weiss | 57/74 |
| 2,500,827 | 3/1950 | Ickringill | 57/115 |
| 2,867,970 | 1/1959 | Richter | 57/115 |
| 3,117,409 | 1/1964 | Shino | 57/67 |
| 4,592,196 | 6/1986 | Wolf | 57/74 |
| 4,779,409 | 10/1988 | Marchiori et al. | 57/74 X |

FOREIGN PATENT DOCUMENTS

| | | |
|---|---|---|
| 0225660 | 6/1987 | European Pat. Off. . |
| 597022 | 8/1936 | Fed. Rep. of Germany . |
| 1080448 | 4/1960 | Fed. Rep. of Germany . |
| 3046180 | 7/1982 | Fed. Rep. of Germany . |
| 3400327 | 7/1985 | Fed. Rep. of Germany . |

*Primary Examiner*—John Petrakes
*Attorney, Agent, or Firm*—Werner W. Kleeman

[57] ABSTRACT

The cap of a cap spinning device comprises a thread introduction attachment in the top or upper region of the cap. In this thread introduction attachment there is arranged an inlet passage which is upwardly directed at an inclination and provided for the thread coming from the drafting arrangement via a thread eye, so that a balloon is formed between the thread eye and the top or upper side of the cap.

14 Claims, 1 Drawing Sheet

Fig. 1
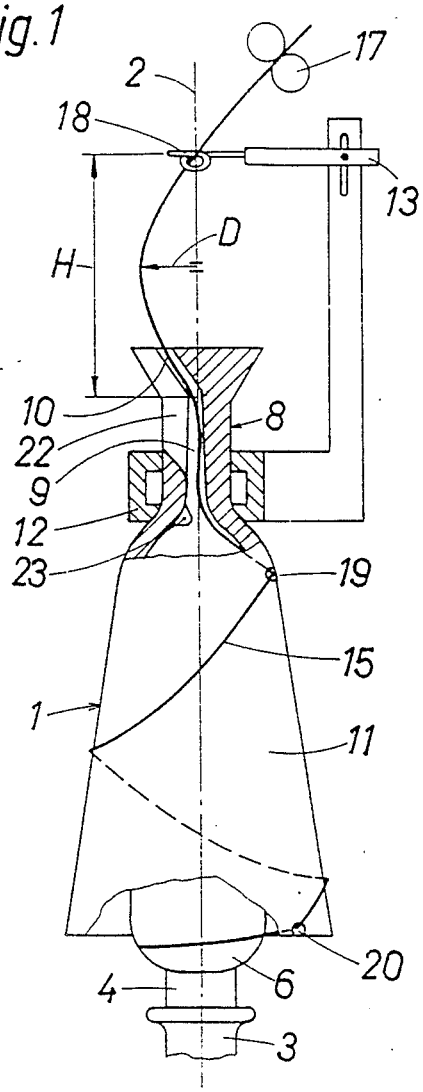
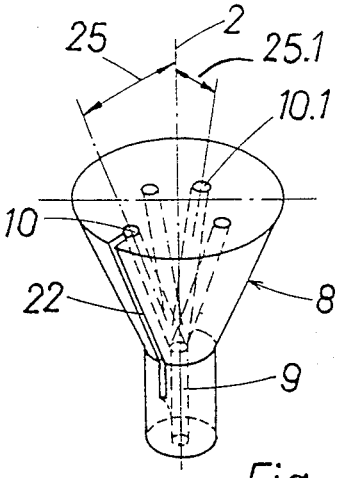
Fig. 2
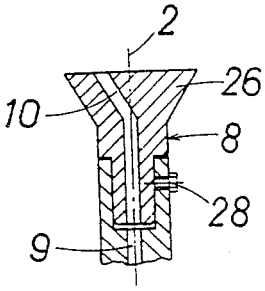
Fig. 3
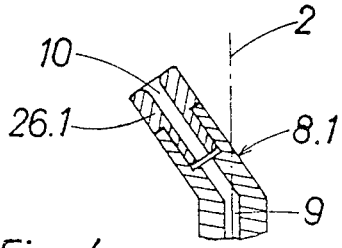
Fig. 4
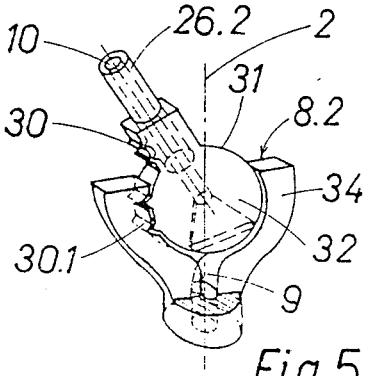
Fig. 5

CAP SPINNING DEVICE

BACKGROUND OF THE INVENTION

The present invention broadly relates to textile machines, especially spinning machines and, in particular, concerns a new and improved construction of a cap spinning device.

Generally speaking, the cap spinning device of the present development is of the type comprising a drivable spindle and a cap or bell or cap member arranged coaxially with respect to the drivable spindle and capable of being rotated about an axis extending coaxially with respect to the axis of rotation of the drivable spindle. The cap or bell contains a thread introduction attachment which guides a thread or the like into the axis of rotation of the drivable spindle.

It should be pointed out that the term "spinning" as used in this disclosure also covers twisting or doubling and the term "cap" or equivalent expressions cover any thread or yarn-guiding body of rotation engaging around or embracing the spindle, and includes, for example, flyer-type structures.

In early constructions of such cap spinning devices, the thread or yarn or the like was guided directly from the thread eye or eyelet to the bottom edge of the cap, as a result of which uncontrollable ballooning limited the speed of rotation of the spindle in particular. However, it was soon realized that any ballooning could be stopped by feeding the thread or the like from the top or above into the axis of rotation of the cap, with the result that it was also possible to overcome difficulties in connection with cap mounting. This idea of eliminating ballooning is also disclosed in later specifications, for example German Published Patent Application No. 3,400,327, published July 18, 1985 and German Published Patent Application No. 3,046,180, published July 15, 1982. Only European Published Patent Application No. 225,660, published June 16, 1987, proposes retaining ballooning between the thread eye and the top or upper end of the cap, the balloon diameter being defined by a cylindrical vertical top or upper part of the cap.

SUMMARY OF THE INVENTION

Therefore with the foregoing in mind it is a primary object of the present invention to provide a new and improved construction of a cap spinning device or the like which does not suffer from the aforementioned drawbacks and shortcomings of the prior art constructions.

Another important object of the present invention is directed to an improved cap spinning device which allows a controllable and influencable balloon formation above the cap with simultaneous thread or yarn feed into the axis of rotation of the cap or bell or the like, thus helping cap spinning to a break-through in practise.

Yet a further significant object of the present invention aims at providing a new and improved cap spinning device which is relatively simple in construction and design, relatively economical to manufacture, extremely reliable in operation, not readily subject to breakdown or malfunction and requires only a minimum of maintenance and servicing.

Now in order to implement these and still further objects of the invention, which will become more readily apparent as the description proceeds, the cap spinning device as contemplated by the present invention, among other things, is manifested by the features that the thread or yarn introduction attachment contains at least one inlet passage or duct which is directed upwardly at an inclination.

By the formation of the thread or yarn balloon it is possible to meet specific requirements in respect of the spun yarn, as regards nature, yarn number, tension, moisture and so forth, so that optimum spinning is possible without thread breaks. At the same time, as a result of the introduction of the thread into the axis of rotation, the cap or bell mounting can be reduced in size, so that the speeds of revolution can be lowered. The present invention is not concerned with the construction of the bottom or lower region or zone of the cap or bell and the thread guidance in that region or zone. Exemplary embodiments in this connection will be found, for example, in U.S. Pat. No. 3,117,409, patented Jan. 14, 1964, U.S. Pat. No. 2,449,431, patented Sept. 14, 1948, and U.S. Pat. No. 2,500,827, patented Mar. 14, 1950 and in German Patent No. 1,080,448, published Apr. 21, 1960 and German Patent No. 597,022, published Aug. 6, 1936. The main point is that the friction or thread retaining force in the bottom or lower region of the cap is selected according to the balloon formation required.

The thread introduction attachment of the cap spinning device constructed according to the invention is advantageously lengthenable in the direction of the axis of rotation. Means are provided for locking the thread introduction attachment after length or positional adjustment thereof.

A further exemplary embodiment of the thread introduction attachment comprises at least one portion or part constructed to be adjustably displaceable in the direction of the axis of rotation. Means are provided for locking the at least one portion after positioning thereof.

In a preferred embodiment of the invention the thread introduction attachment constitutes a body of rotation comprising a plurality of inlet passages or ducts which have different angles of inclination relative to the axis of rotation.

In a further construction of a simple embodiment of the invention, a tube or pipe bent away from the axis of rotation constitutes the thread introduction attachment containing the at least one inlet passage or duct directed upwardly at an inclination or directed at an angle to the axis of rotation. The bent-away tube part can also be lengthenable or selectively positionally adjustable in the direction of its axis and then lockable after length or positional adjustment.

Mounting means for the inventive cap spinning device are advantageously provided in the region between the body of the cap or bell and the thread introduction attachment. A thread eye or eyelet is rigidly connected to the cap and means for elevationally adjusting the thread eye relative to the cap are provided, thus defining a predetermined spacing set by the elevationally adjusting means.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 1 is a vertical elevation of a first exemplary embodiment of a cap spinning device constructed according to the invention, shown partially in section;

FIG. 2 is a perspective view of a second exemplary embodiment of a thread introduction attachment of the cap spinning device;

FIG. 3 is a vertical section through a third exemplary embodiment of a thread introduction attachment of the cap spinning device;

FIG. 4 is a vertical section through a fourth exemplary embodiment of a thread introduction attachment of the cap spinning device; and FIG. 5 is a perspective view of a fifth exemplary embodiment of a thread introduction attachment of the cap spinning device.

DETAILED DESCRIPTION OF THE PREFERRED EMBODIMENTS

Describing now the drawings, it is to be understood that to simplify the showing thereof, only enough of the cap spinning device has been illustrated therein as is needed to enable one skilled in the art to readily understand the underlying principles and concepts of this invention. Turning now specifically to the drawings, FIG. 1 shows a cap or bell or cap member 1 mounted for rotation about an axis of rotation 2 and engaging around a drivable spindle 3. This drivable spindle 3 together with a tube or sleeve 4 having a cop package 6 is mounted coaxially with respect to the axis of rotation 2. In the top or upper region or zone the cap or bell 1 comprises a thread introduction attachment 8 which is connected to a body or body member 11 of the cap or bell 1 either integrally or by some other appropriate fixing method.

The thread introduction attachment 8 has a substantially vertical central bore 9 in the region or zone where the cap 1 narrows, and an upwardly conically divergent shape. The cap or bell 1 together with the thread introduction attachment 8 constitutes a body of rotation or revolution. A single inlet passage or duct 10 directed upwardly at an inclination is provided in the divergent part of the thread introduction attachment 8 and leads into the vertical central bore 9. The mounting 12 for the cap or bell 1 is located in the region where the cap or bell 1 narrows towards the thread introduction attachment 8 and is rigidly connected to a thread eye or eyelet holder 13 but with appropriate provision for height or elevational adjustment.

The cap 1 may be stationary and the drivable spindle 3 movable in the direction of the axis of rotation 2, or vice versa, so that the cap 1 and the drivable spindle 3 are movable relatively to one another, the distance to which the space between the thread eye holder 13 and the cap 1 has been set being maintained. A thread or yarn 15 or the like coming from drafting rolls 17 runs through the thread eye or eyelet 18 or the like in the direction of thread or yarn movement and into the inlet passage or duct 10 which guides the thread or yarn 15 into or towards the axis of rotation 2 or the vertical central bore 9. The thread or yarn 15 emerges through an aperture or opening 19 in the cap 1 beneath the mounting or support 12. After looping of the thread or yarn 15 around the outer surface of the cap 1, the thread or yarn 15 passes through an opening or aperture or recess 20 in the bottom edge of the cap 1 onto the tube 4 and forms the cop package 6.

When a thread or yarn break or breakage is cleared, the thread or yarn 15 is usually passed from the cop package 6 to the drafting rolls 17. To simplify introduction of the thread or yarn 15 through the aperture or opening 19 into the inlet passage or duct 10, a continuous lengthwise slot 22 is provided in the thread introduction attachment 8 to vertically extend across a part or portion thereof, and a lug or nose or bracket 23 is provided on the inner wall of the cap 1 in the region or zone of the vertical central bore 9 in order to prevent downward deflection of the thread after introduction through the aperture or opening 19. Controlled formation of a thread or yarn balloon between the thread eye or eyelet 18 and the cap 1 can be obtained, on the one hand, by elevational adjustment of the thread eye (height H) and, on the other hand, by a change of the balloon (diameter D) and thus of the thread adhesion, for example, by changing the thread or yarn looping.

FIG. 2 shows a number of inlet passages or ducts 10 in the divergent rotary part of the thread introduction attachment 8, all these inlet passages or ducts 10 leading into the vertical central bore 9 and all forming a different angle or inclination with the axis of rotation 2. For example, the inlet passage or duct 10 forms an angle 25 with the axis of rotation 2, while an inlet passage or duct 10.1 forms a different angle 25.1 with the axis of rotation 2. The diameter D can be influenced by the inclination or angle of the inlet passages or ducts 10. For the sake of clarity, FIG. 2 shows only one inlet passage or duct 10 with one lengthwise slot 22.

FIG. 3 shows a construction in which the thread introduction attachment 8 is capable of being lengthened in the direction of the axis of rotation 2, a top part or piece 26 being structured to be selectively positionally adjustable as by being telescopingly extendable or screwed out. The height H of the thread or yarn balloon is particularly influenced in this manner. The top part or piece 26 can be appropriately locked in the thread introduction attachment 8 in the required position, for example, by means of a screw 28 or equivalent fixation facility.

The inlet passage or duct 10 may be situated in a lengthenable and lockable top part or piece 26.1 constructed as a tube or pipe bent away or angularly offset from the axis of rotation 2, as shown in FIG. 4. In this case, therefore, the thread introduction attachment 8.1 is not a body of rotation or revolution.

The exemplary construction shown in FIG. 5 comprises a tubular top part or piece 26.2 constructed to be lengthenable or positionally adjustable and lockable by detent or latching means 30 in a middle part or piece 31. The latter comprises a hollow disc 32 having an outer edge in the form of part of a circle, and is mounted for rotation in a substantially cup-shaped bottom part or piece or cradle 34 of the thread introduction attachment 8.2 and is lockable or positionally arrestable by detent or latching means 30.1. The substantially parallel retaining walls of the bottom part or piece 34 surrounding the hollow disc 32 have been conveniently omitted from the drawing for the sake of clarity. The middle part or piece 31 and the bottom part or piece 34 thus form a joint having one degree of freedom of movement, the required angle adjustment being obtainable by the detent means 30.1 and the middle part or piece 31 forming the movable part of the joint. Although a ball joint would be possible, it is unnecessary.

In the herein described exemplary embodiments, the cap or bell 1 is entrained or dragged by the thread or yarn 15. Alternatively, however, the cap or bell 1 may be driven mechanically or electrically, or accelerating and braking means may be provided. The drivable or rotatable spindle 3 is driven either by a belt drive or individually by an electric motor, by way of example.

While there are shown and described present preferred embodiments of the invention, it is to be distinctly understood that the invention is not limited thereto, but may be otherwise variously embodied and practiced within the scope of the following claims. Accordingly,

What I claim is:

1. A cap spinning device, comprising:

a drivable spindle having an axis of rotation;

a cap arranged substantially coaxially with respect to said drivable spindle and capable of being rotated about an axis extending substantially coaxially with respect to said axis of rotation of said drivable spindle;

said cap being provided with a balloon forming thread introduction attachment;

said balloon forming thread introduction attachment guiding a thread into said axis of rotation of said drivable spindle;

said balloon forming thread introduction attachment containing a body provided with a substantially central bore having two ends;

one end of said two ends of said substantially central bore opening into the interior of the cap; and said body of said balloon forming thread introduction attachment containing at least one inlet passage extending at an inclination from an other end of said two ends of said substantially central bore through said body of said balloon forming thread introduction attachment.

2. The cap spinning device as defined in claim 1, wherein:

said at least one inlet passage constitutes a plurality of inlet passages extending from said other end of said substantially central bore at different angles of inclination.

3. The cap spinning device as defined in claim 1, further including:

means for mounting said cap;

said cap comprising a body; and said mounting means being located in the region between said balloon forming thread introduction attachment and said body of said cap.

4. The cap spinning device as defined in claim 1, wherein:

said thread introduction attachment contains said inlet passage in a member directed upwardly at a variable angle of inclination; and locking means for locking said member at preselected angles of inclination.

5. The cap spinning device as defined in claim 1, further including:

a thread eye;

means for rigidly connecting said thread eye to said cap; and means for elevationally adjusting said thread eye relative to said cap.

6. The cap spinning device as defined in claim 5, wherein:

said thread eye and said cap define a predetermined spacing set by said elevationally adjusting means; and said cap and said drivable spindle being movable relative to one another in the direction of said axis of rotation while maintaining said predetermined spacing between said thread eye and said cap.

7. The cap spinning device as defined in claim 1, wherein:

said thread introduction attachment comprises at least one longitudinal slot extending from the exterior into the body of said balloon forming thread introduction attachment and communication with said at least one inlet passage.

8. The cap spinning device as defined in claim 1, wherein:

said thread introduction attachment comprises a longitudinal slot extending from the exterior into the body of said balloon forming thread introduction attachment and communicating with said inlet passage and said substantially central bore of said thread introduction arrangement;

said cap has an inner wall arranged in the region of said thread introduction attachment;

said cap containing an opening for introducing, after a thread breakage, a thread through the opening in the cap into said central bore of said thread introduction arrangement; and lug means provided at said inner wall of said cap for preventing deflection of the thread away form said central bore of said thread introduction attachment after introduction of the thread through said opening of said cap.

9. A cap spinning device, comprising:

a drivable spindle having an axis of rotation;

a cap arranged substantially coaxially with respect to said drivable spindle and capable of being rotated about an axis extending substantially coaxially with respect to said axis of rotation of said drivable spindle;

said cap being provided with a thread introduction attachment;

said thread introduction attachment guiding a thread into said axis of rotation of said drivable spindle;

said thread introduction attachment containing at least one inlet passage directed upwardly at an inclination;

said thread introduction attachment having a variable length as viewed in the direction of said axis of rotation;

means for adjusting said variable length of said thread introduction attachment in the direction of said axis of rotation; and means for locking said thread introduction attachment after length adjustment thereof in the direction of said axis of rotation.

10. A cap spinning device, comprising:

a drivable spindle having an axis of rotation;

a cap arranged substantially coaxially with respect to said drivable spindle and capable of being rotated bout an axis extending substantially coaxially with respect to said axis of rotation of said drivable spindle;

said cap being provided with a thread introduction attachment;

said thread introduction attachment guiding a thread into said axis of rotation of said drivable spindle;

said thread introduction attachment containing at least one inlet passage directed upwardly at an inclination;

said thread introduction attachment having at least one portion adjustably displaceable in the direction of said axis of rotation; and means for locking said at least one portion of said thread introduction attachment after displacement of said at least one portion in the direction of said axis of rotation.

11. A cap spinning device, comprising:

a drivable spindle having an axis of rotation;

a cap arranged substantially coaxially with respect to said drivable spindle and capable of being rotted about an axis extending substantially coaxially with respect to said axis of rotation of said drivable spindle;

said cap being provided with a thread introduction attachment;

said thread introduction attachment guiding a thread into said axis of rotation of said drivable spindle;

said thread introduction attachment containing at least one inlet passage directed upwardly at an inclination;

said thread introduction attachment comprising a tube angularly bent away from said axis of rotation and having a bent-away part;

said tube containing said at least one inlet passage directed upwardly at an inclination;

said angularly bent-away part of said tube having an axis;

said angularly bent-away part of said tube having a variable length as viewed in the direction of said axis of said bent-away part;

means for adjusting said variable length of said bent-away part in the direction of said axis of said bent-away part; and means for locking said bent-away part after adjustment in the direction of said axis of said angularly bent-away part.

12. The cap spinning device as defined in claim 11, wherein:

said thread introduction attachment contains said inlet passage in a member directed upwardly at a variable angle of inclination;

locking means for locking said member at preselected angles of inclination;

said member containing a tube portion which is adjustable in the direction of said axis of said bent-away part; and said member further containing said means for locking said adjustable tube portion after adjustment in the direction of said axis of said bent-away part.

13. A cap spinning device, comprising:

a drivable spindle having an axis of rotation;

a cap arranged substantially coaxially with respect to said drivable spindle and capable of being rotated about an axis extending substantially coaxially with respect to said axis of rotation of said drivable spindle;

said cap being provided with a thread introduction attachment;

said thread introduction attachment guiding a thread into said axis of rotation of said drivable spindle;

said thread introduction attachment containing at least one inlet passage directed upwardly at an inclination;

said thread introduction attachment comprising a tube angularly bent away from said axis of rotation and having a bent-away part;

said tube containing said at least one inlet passage directed upwardly at an inclination;

said angularly bent-away part of said tube having an axis;

said angularly bent-away part of said tube having at least one portion adjustably displaceable in the direction of said axis of said angularly bent-away part; and means for locking said at least one portion of said angularly bent-away part after displacement of said at least one portion of said angularly bent-away part.

14. A cap spinning device, comprising:

a rotatable spindle having an axis of rotation;

a cap arranged coaxially with respect to said rotatable spindle and rotatable about an axis extending substantially coaxially with respect to said axis of rotation of said rotatable spindle;

a thread introduction attachment provided for said cap;

said thread introduction attachment guiding a thread towards said axis of rotation of said rotatable spindle;

said thread introduction attachment containing a body provided with a substantially central bore having two ends;

one end of said two ends of said substantially central bore opening into the interior of said cap; and said body of said thread introduction attachment being provided with at least one inlet passage extending at an inclination relative to said axis of rotation from an other end of said two ends of said substantially central bore through said body of said thread introduction attachment.

* * * * *